US008533958B2

(12) United States Patent
Tomassetti et al.

(10) Patent No.: US 8,533,958 B2
(45) Date of Patent: Sep. 17, 2013

(54) RAZOR WITH BLADE HEATING SYSTEM

(75) Inventors: Louis D. Tomassetti, Pompano Beach, FL (US); William Bohmer, Randolph, NJ (US)

(73) Assignees: L.P.I. Consumer Products, Inc., Pompano Beach, FL (US); Display Matrix Corp., Randolph, NJ (US)

( * ) Notice: Subject to any disclaimer, the term of this patent is extended or adjusted under 35 U.S.C. 154(b) by 0 days.

(21) Appl. No.: 13/417,932

(22) Filed: Mar. 12, 2012

(65) Prior Publication Data

US 2012/0227265 A1 Sep. 13, 2012

Related U.S. Application Data

(62) Division of application No. 12/082,840, filed on Apr. 15, 2008, now abandoned.

(51) Int. Cl.
*B26B 21/48* (2006.01)

(52) U.S. Cl.
USPC ..... 30/34.05; 30/140

(58) Field of Classification Search
USPC ..... 30/34.05, 140
See application file for complete search history.

(56) References Cited

U.S. PATENT DOCUMENTS 4,918,818 A * 4/1990 Hsieh ..... 30/34.05
6,065,391 A * 5/2000 Archard et al. ..... 99/342
6,817,101 B1 * 11/2004 Bohmer ..... 30/34.05
6,836,966 B2 * 1/2005 Patrick ..... 30/34.05
7,788,810 B2 * 9/2010 Noble ..... 30/41.5
2006/0026841 A1 * 2/2006 Freund ..... 30/32
2006/0037197 A1 * 2/2006 Hawes et al. ..... 30/45
2006/0070242 A1 * 4/2006 Szczepanowski et al. ..... 30/140
2009/0000124 A1 * 1/2009 Micinilio et al. ..... 30/34.1
2009/0255123 A1 * 10/2009 Tomassetti et al. ..... 30/34.05
2011/0314677 A1 * 12/2011 Meier et al. ..... 30/41.8
2012/0222310 A1 * 9/2012 Tomassetti et al. ..... 30/34.05
2012/0227265 A1 * 9/2012 Tomassetti et al. ..... 30/34.05

* cited by examiner

*Primary Examiner* — Hwei C Payer

(74) *Attorney, Agent, or Firm* — Robert M. Downey, P.A.

(57) ABSTRACT

In a razor having a handle and a blade cartridge containing one or more blades, a system is provided for selectively heating the blades to a controlled temperature range. The blade heating system includes an electric circuit with a battery power source for controlled direction of current flow through the blades in order to heat the blades. The electric circuit includes an automatic on/off switch, such as a proximity switch or a tilt switch with a timer for opening the circuit after an elapsed period for preserving battery life, a visual indicator for indicating on/off status, and a heat controller for selectively adjusting the temperature of the blades. With the exception of the blades, the components of the electric circuit are carried in the razor's handle and an inductive coupling is provided at the connection of the handle and blade cartridge for electrically connecting the blades to the electric circuit.

8 Claims, 8 Drawing Sheets

RAZOR WITH BLADE HEATING SYSTEM

This application is a Divisional Application based on non-provisional patent application Ser. No. 12/082,840 filed on Apr. 15, 2008, now abandoned.

BACKGROUND OF THE INVENTION

1. Field of the Invention

The present invention relates generally to razors for shaving and, more particularly, to a battery powered system in a razor for controlled heating of one or more blades of the razor wherein the battery is preserved using an automatic switch.

2. Discussion of the Related Art

It is well known that hairs are softened and easier to cut when they are heated just prior to being cut by the sharp cutting edge of a razor blade. It is also known that the cutting edge of the razor blade is more effective in cutting hairs when the blade is warm or hot. Just prior to shaving, most people warm the hairs and skin with hot water or a hot towel. It is also common practice to place the shaver under hot running water in order to heat the blades just prior to stroking the blades over the skin in order to cut the hairs. However, the heat cutting performance of the blades lasts only a short time during the beginning of the shaving stroke. Within seconds, the temperature of the skin surface, hairs and blade are quickly reduced due to exposure to the ambient air temperature. Ideally, it is best to maintain the blades warm or hot throughout the shaving process.

One particular prior art blade heating invention, disclosed in U.S. Pat. No. 6,817,101 B1 to Bohmer, provides a shaving system with a continuously heated blade cartridge throughout the shaving stroke. Heating the blades is attained by applying a measured amount of electric current to the blade cartridge by means of conductors connected to each side of the blade cartridge and extended in the form of contacts at the connection of the blade cartridge to a razor handle. Electric current is provided by a primary battery contained in a waterproof compartment in the razor handle. Current provided by the battery renders optimum heat generation in the blades in the cartridge and can be adjusted by means of resistors in series with the blade and blade cartridge. A momentary contact switch closes the circuit and is operated by the user during the shaving stroke.

The present invention improves upon the shaving system disclosed in U.S. Pat. No. 6,817,101 B1 and provides for a heat controller for allowing the user to selectively adjust the heated temperature of the blades for desired comfort and optimum blade cutting efficiency. The present invention further provides for a visual indictor, such as an LED, to indicate on and off status of the blade heating system. A further improvement provided by the present invention is an automatic turn-off switch, in addition to a user controlled on/off switch such as a proximity switch or a tilt switch with a timer for opening the circuit after an elapsed period for automatically turning the heating system off after use of the razor, thereby preserving battery life. Additionally, the heat controller may be combined with a vibration feature for additional shaving comfort.

SUMMARY OF THE INVENTION

In a razor having a handle and a removable blade cartridge containing one or more blades, a system is provided for selectively heating the blades to a controlled temperature range. The blade heating system includes an electric circuit with a battery power source for controlled direction of current flow through the one or more blades in order to heat the blades. The electric circuit includes an automatic on/off switch, such as a proximity switch or a tilt switch with a timer for opening the circuit after an elapsed period for preserving battery life, a visual indicator for indicating on/off status, and a heat controller for selectively adjusting the temperature of the blades. All of the components of the electric circuit, with the exception of the one or more blades, may be carried in the handle of the razor and an inductive coupling is provided at the connection of the handle and blade cartridge for electrically connecting the one or more blades to the electric circuit.

OBJECTS AND ADVANTAGES OF THE INVENTION

Considering the foregoing, it is a primary object of the present invention to provide a blade heating system in a razor that allows for controlled adjustment of the heated temperature of one or more blades in the blade cartridge of the razor.

It is a further object of the present invention to provide a blade heating system in a razor for controlling the heated temperature of one or more blades in the blade cartridge of a razor, and wherein the heated temperature level is visually indicated on a display.

It is still a further object of the present invention to provide a heating system in a razor for heating one or more blades in the blade cartridge of the razor and including a visual indicator for indicating an on and off status of the heating system.

It is still a further object of the present invention to provide a heating system in a razor for heating one or more blades in the razor cartridge and including an automatic turn off switch for turning the heating system off after use, thereby preserving battery life.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1A:
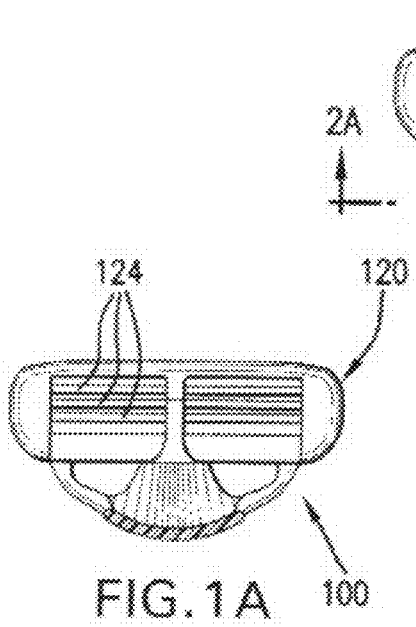
FIG. 1A is an isolated top plan view taken along the plane of the line 2A-2A in FIG. 1.
Figure 2:
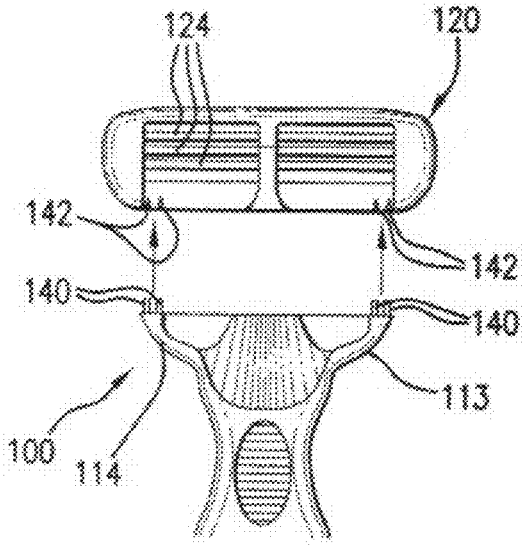
FIG. 2 is an isolated top plan view illustrating connection of the razor handle to the blade cartridge according to the embodiment of FIG. 2.
Figure 1:
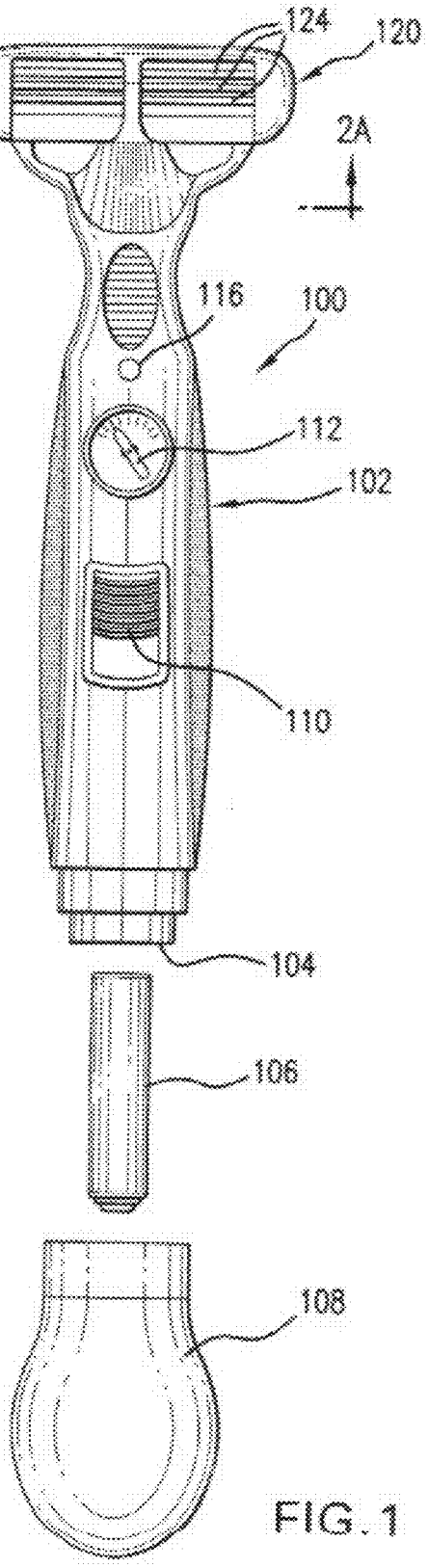
FIG. 1 is a top plan view, partially exploded, showing a second embodiment of the invention wherein a battery power source, switches, a heat controller, and a heat indicator are carried in the handle of the razor for directing controlled electric current flow through the one or more blades in the blade cartridge of the razor in order to heat the one or more blades to a selected temperature level within a predetermined temperature range.

FIGS. 1-2 illustrate a preferred embodiment of the invention, generally indicated as 100, wherein all of the components of the electric circuit of the blade heating system, with the exception of the one or more blades, are carried in the handle 102 of the razor 100. Specifically, the handle 102 of the razor includes a battery compartment 104 for holding one or more batteries 106. By removing the bottom end 108 of the handle 102, the batteries 106 can be removed and replaced, as needed. It should be noted that rechargeable batteries, such as lithium batteries, may be used to eliminate a voltage drop throughout the life of the battery. Use of rechargeable batteries provides for a steady and consistent voltage source to maintain the adjusted blade heat levels consistent throughout the life of the batteries.

The razor 100 may further include an ON/OFF switch 110 on the handle for activating and deactivating the blade heating system. In a preferred embodiment, the ON/OFF switch 110 is provided as a single slide switch, which may be of the type that is normally biased to a relaxed position, as shown in FIG. 1. By moving the ON/OFF switch 110, in a sliding downward motion, against a spring biased force, the blade heating system circuit is closed. Subsequent movement of the ON/OFF slide switch 110, in the same action, serves to open the circuit, thereby deactivating the blade heating system. The ON/OFF switch 110 also may be a push button type switch.

Figure 3:
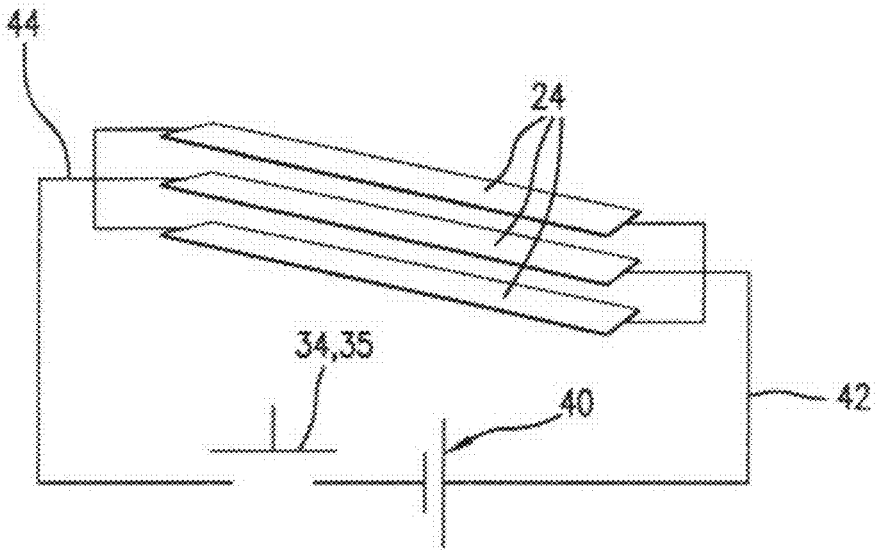
FIG. 3 is a general schematic diagram showing one embodiment wherein the blades of the razor are electrically connected in parallel.
Figure 4:
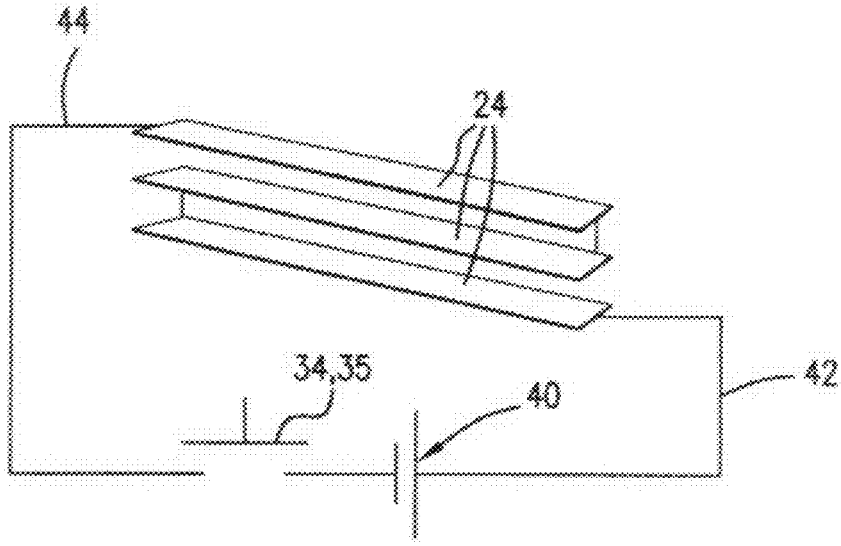
FIG. 4 is a general schematic diagram showing another embodiment wherein the blades are electrically connected in series.

Referring to FIGS. 3 and 4, electric current flow through the blades 24 is achieved by electrical conductors 42, 44 connecting at opposite ends of the blades and to the positive and negative terminals of the battery source 40 contained within the water-tight housing 30. The conductors 42, 44 may be connected to the blades 24 in parallel or series. Examples of the parallel and series blade connections in the circuit are shown in FIGS. 3-8C, as described in more detail hereinafter. The blade heating system circuit may further be provided with a timer or other device (e.g., a tilt switch or proximity switch) for opening the circuit, thereby deactivating (i.e., turning off) the blade heating system, in the event the user forgets to turn the blade heating system off. In this instance, the circuit will be opened, thereby turning off the blade heating system, after a predetermined period of time has lapsed or by some other action (e.g., a tilt switch or proximity switch) that is normally performed when a user has completed the shaving process.

A slide switch or pressure actuated switch (ON/OFF switch 110) may be substituted for a proximity switch 34, 35. More specifically, a proximity switch 34, 35 would allow the current flow to the blades upon contact of the blades with the user's skin. In this particular embodiment, the proximity switch 34, 35 acts as a capacitive and resistive sensing circuit that senses a difference in resistance or capacitance when the blades come in contact with the skin. Another embodiment may employ a contact switch 34, 35 or other type switch that closes when the blade cartridge pivots in response to pressure against the user's skin. The use of a proximity switch 34, 35 or other types of switches of this nature, in order to activate the blade heating system, serves as a highly effective means for preserving battery life. Other battery preserving measures include use of a timer, tilt switch 34, 35 or other device, as described above, for opening the circuit in the event the user fails to turn the blade heating system off after shaving.

A dial 112 or other user controllable device is provided on the handle 102 for adjusting the temperature level of the blades 124 when the blade heating system is ON. Temperature adjustment and control may be achieved by various devices, such as a pulsating switch, self-interrupting reed relays or a rotating motor. The use of a pulsating switch or a rotating motor may further provide a vibration feature which may be desirable when shaving. A visual indicator, such as a single light or multiple lights, may be provided on the handle of the razor to indicate the ON and OFF status of the blade heating system. In one embodiment, a single light indicator 116, such as an LED, may be provided on the handle. In this instance, the single LED may be of the type that changes color when the circuit is open and closed. For example, when the circuit is open (i.e., in an OFF status) the LED 116 might be red in color. Turning the blade heating system on, by closing the circuit, may change the LED 116 to a green color, thereby indicating to the user that the blade heating system has been activated.

Figure 9:
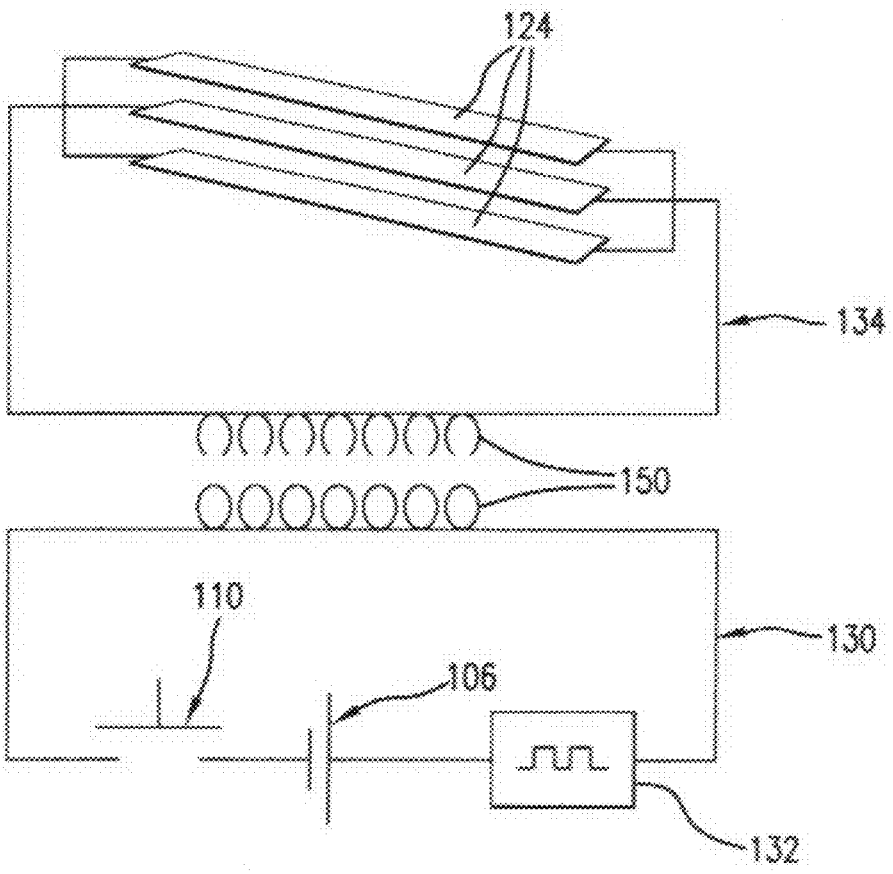
FIG. 9 is a general schematic diagram illustrating an inductive connection between the blade cartridge and the handle, in accordance with the embodiment of FIG. 2, wherein the battery power source and components are contained within the handle.

The blade cartridge 120, containing one or more blades 124, removably attaches to the top end of the handle to provide an electrical coupling which connects the blades 124 to the blade heating system circuit in the handle 102. Electrical connection of the blade heating system circuit 130 in the handle 102 to the circuit 134 blade cartridge, and particularly the blades 124, may be achieved by prong connectors 140 extending from the connecting members 113, 114 on the top end of the handle 102. The conductive prongs 140 are received within ports 142 or receptacles in the blade cartridge 120. The receptacles 142 are electrically connected to the one or more blades 124 in the blade cartridge. Again, the blades 124 may be connected in parallel, as shown in FIG. 3 or, alternatively, in series, as shown in FIG. 4. In another embodiment, the blade cartridge 120 may be electrically connected to the top end of the handle 102 by an inductive coupling 150, as shown in FIG. 9. In this particular embodiment, the blade heating system circuit 130 in the handle may be provided with a step-down transformer 132. The inductive coupling 150 transfers energy from the blade heating system circuit 130 in the handle to the circuit 134 in the blade cartridge 120 through a shared magnetic field. Specifically, a change in current flow through the circuit 130 in the handle 102 induces current flow in the circuit 134 of the blade cartridge as a result of the close, spaced relation at the inductive coupling 150, wherein both circuits are within a shared magnetic field. It is important to note that an inductive coupling of this nature provides the benefit of a completely water-tight electrical connection between the blade cartridge circuit 134 and the electric circuit 130 within the handle 102 of the razor 100.

Figure 5:
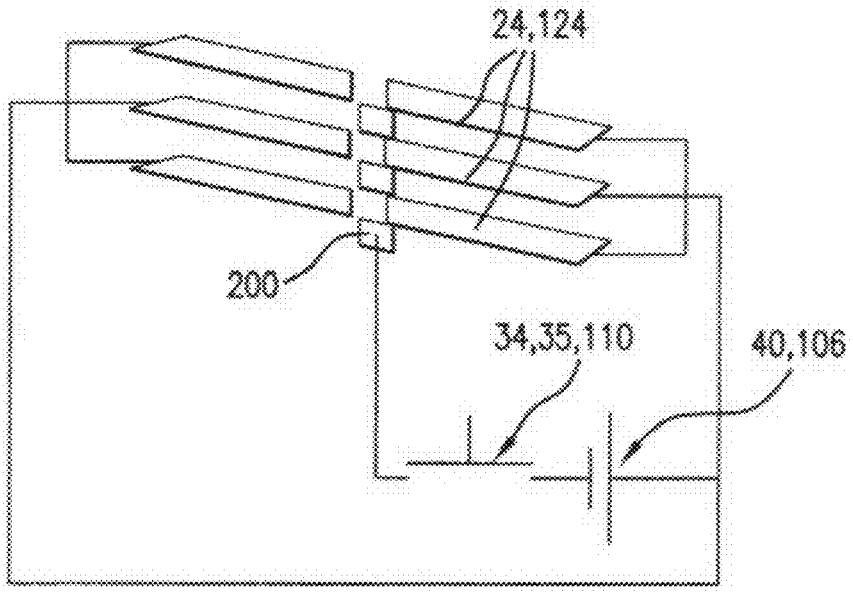
FIG. 5 is a general schematic diagram showing the electrical connection of the blades in parallel with a center tap connection.
Figure 6:
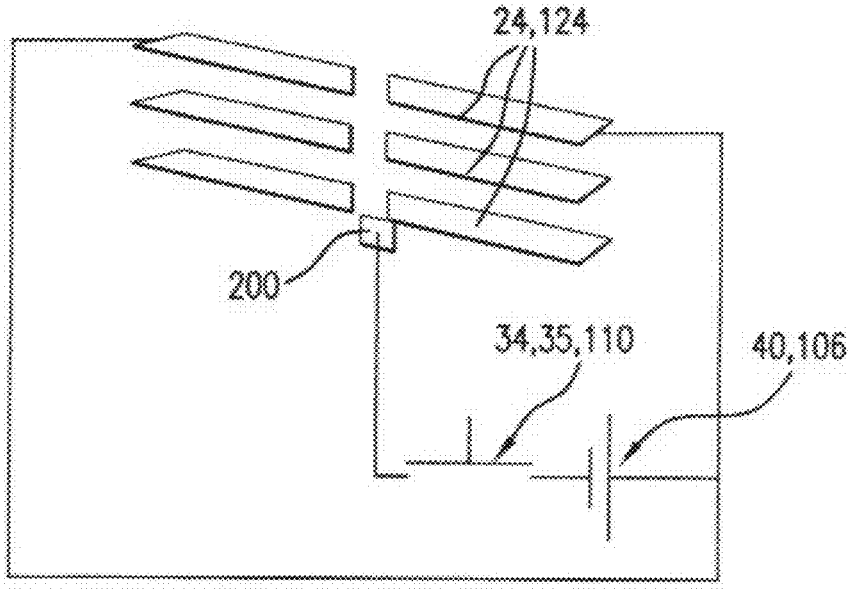
FIG. 6 is a general schematic diagram showing the electrical connection of the blades in series with a center tap connection.

FIGS. 5 and 6 illustrate a further embodiment of the electrical connection of the blades (24, 124) in the blade cartridge through a center tap connection 200. Specifically, FIG. 5 shows three blades in the blade cartridge connected in parallel through a center tap connection 200. FIG. 6 shows the three blades in the blade cartridge connected in series through a center tap connection 200. Use of a center tap connection 200 may be beneficial to provide consistent heat levels across the entire length of the blades.

Figure 7A:
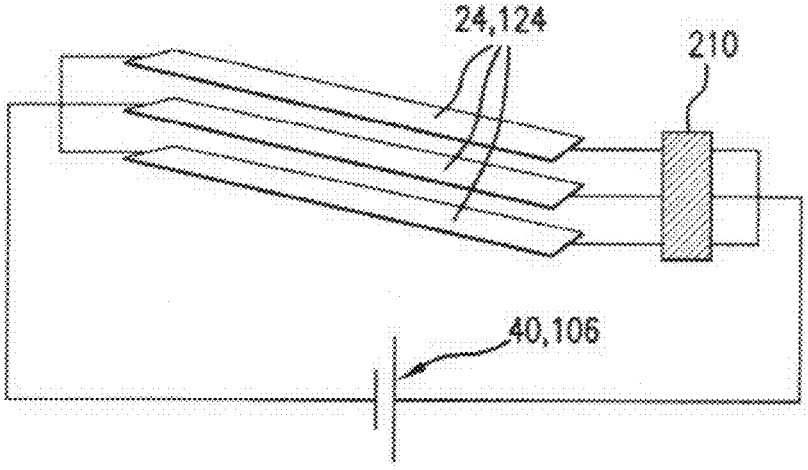
FIGS. 7A-7C illustrate a sequence of operation of a slide switch to control current flow through the blades connected in parallel in accordance with one embodiment of the heat controller.
Figure 7B:
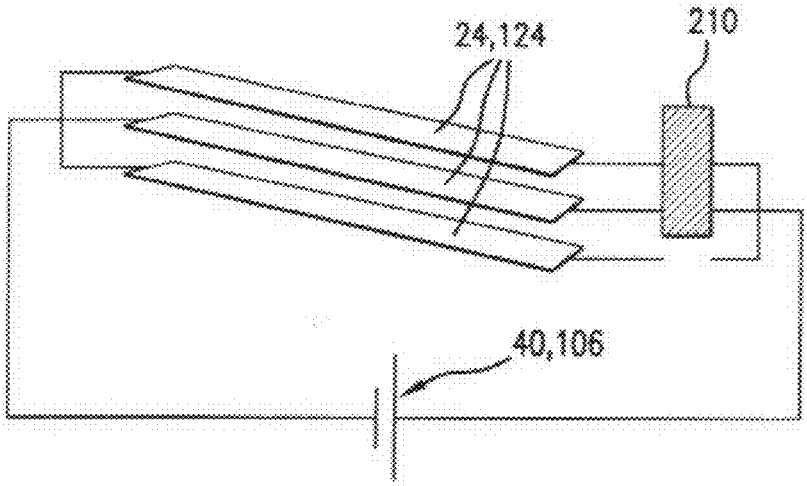
Figure 7C:
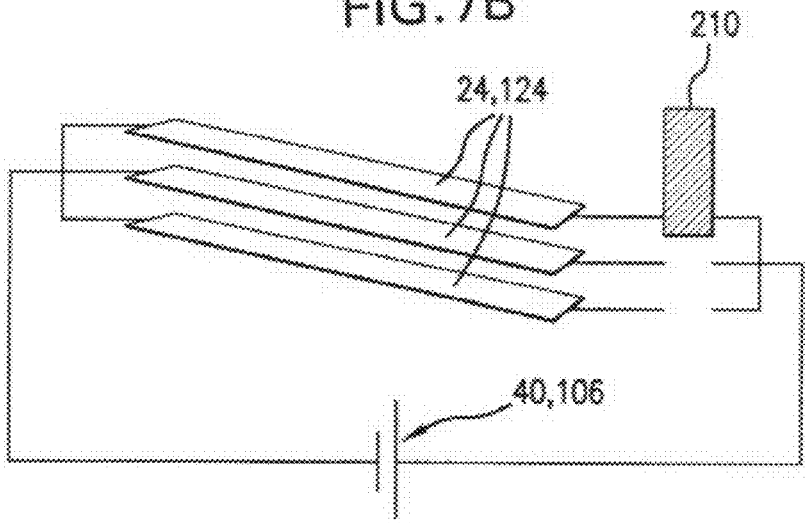

FIGS. 7A-7C illustrate an example of a slide switch control 210 for adjustably controlling the temperature level of the blades (24, 124), wherein the blades (24, 124) in the blade cartridge (20, 120) are connected in parallel. In this example, FIG. 7A shows the slide switch 210 completely closing the parallel connection of the three blades so that current flow is directed through all three of the blades rendering the lowest resistance, thereby providing the hottest temperature levels. FIG. 7B slows the slide switch 210 moved to disconnect the lower blade from the circuit, so that current flow is only directed through the middle blade and the top blade rendering medium resistance. This produces a medium level of heat. FIG. 7C shows the slide switch 210 moved to a third position, wherein the middle blade and the bottom blade are disconnected from the circuit so that current flow is only directed through the top blade rendering the highest resistance, thereby producing a temperature level that is not as hot as achieved in the slide switch positions of FIGS. 7A and 7B.

Figure 8A:
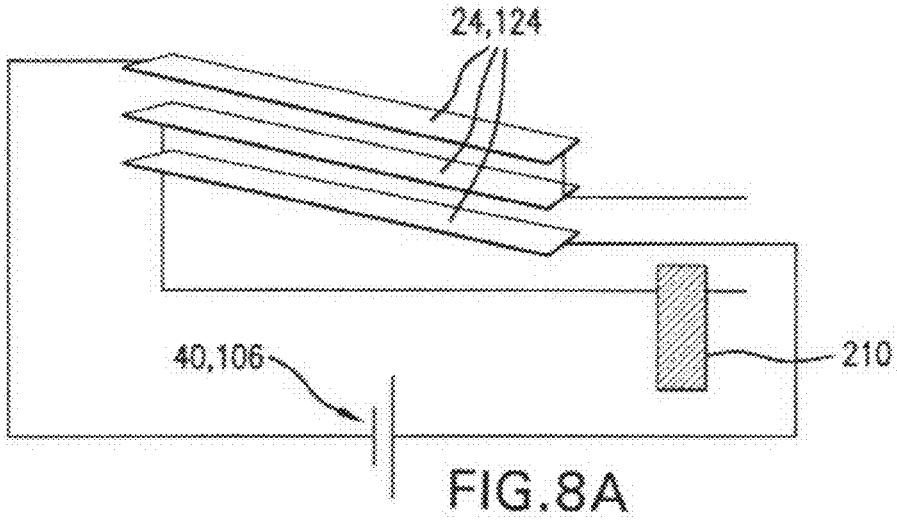
FIGS. 8A-8C illustrate a sequence of operation of a slide switch for controlling current flow through the blades connected in series in accordance with a further embodiment of the heat controller.
Figure 8B:
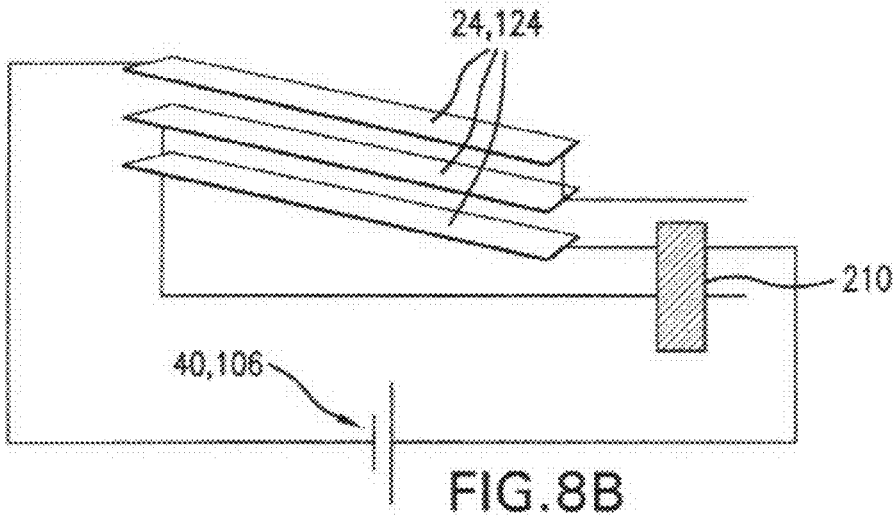
Figure 8C:
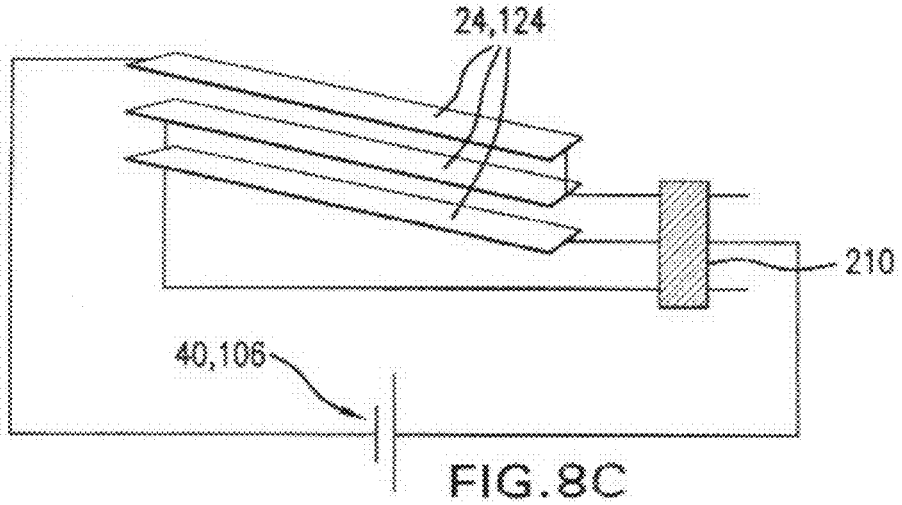

FIGS. 8A-8C illustrate a sequence of operation of a slide switch 210 to control blade temperature levels with the blades connected in series. In this example, FIG. 8A shows the slide switch 210 moved to the maximum resistance three blades in series low temperature position. In FIG. 8B, the slide switch 210 is moved to the medium resistance wherein two blades are connected in series to define a medium temperature position. FIG. 8C shows the slide switch moved to the minimum resistance wherein only one blade is in series to define the hottest temperature adjusted position.

Figure 10A:
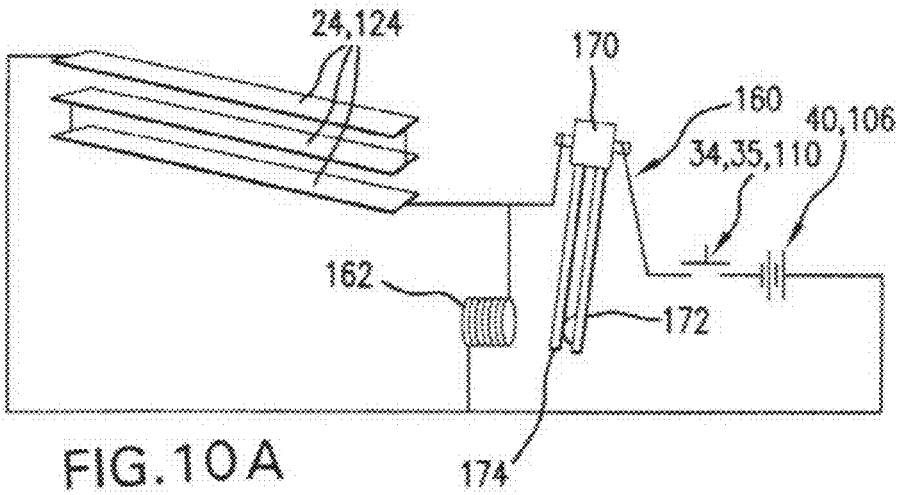
FIGS. 10A-10D illustrate a sequence of operation of a pulsating switch in accordance with a further embodiment of a heat controller for controlling the temperature of the heated blades.
Figure 10B:
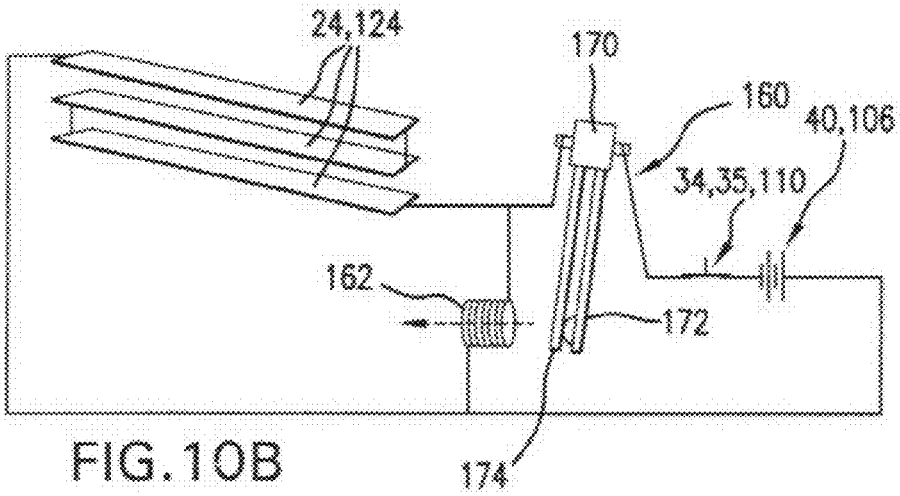
Figure 10C:
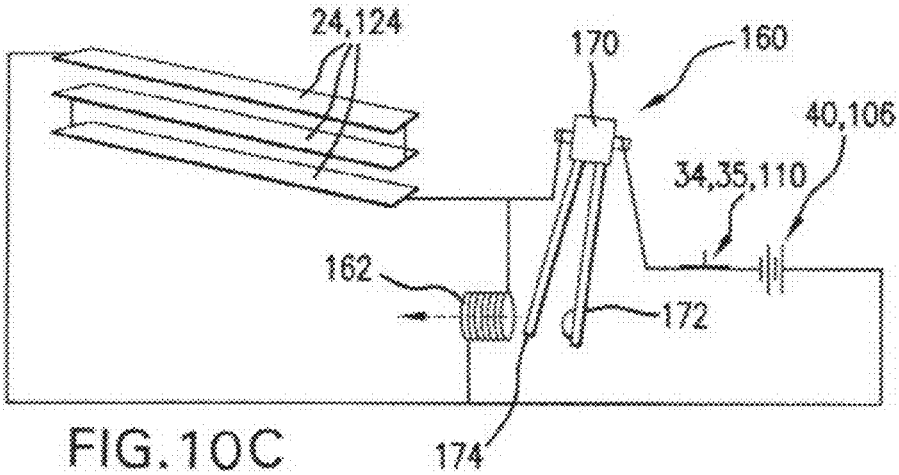
Figure 10D:
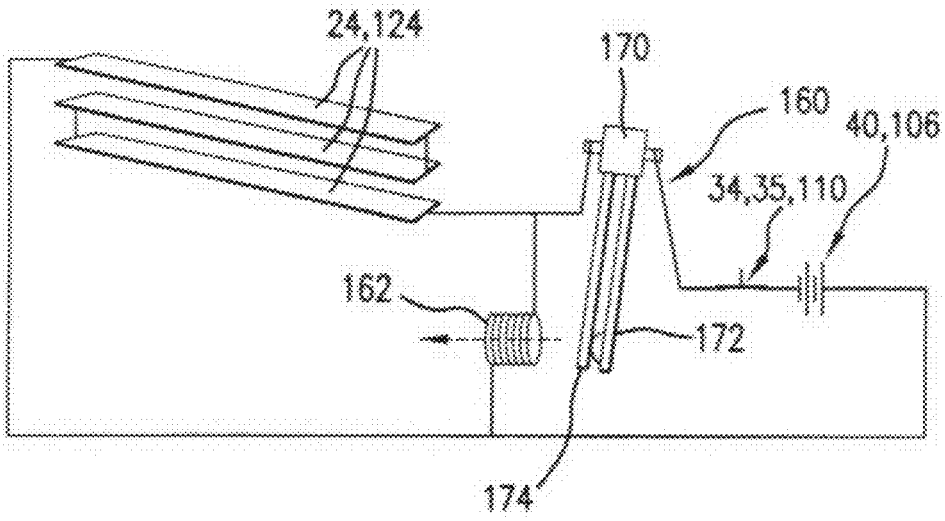

FIGS. 10-10D illustrate a sequence of operation of a pulsating switch 160 as an example of one embodiment for providing for adjusted control of the blade heat level. In the example shown in FIGS. 10A-10D, three blades are connected in series. In FIG. 10A, the switch 110 is open (i.e., OFF), and thus the circuit is open. FIG. 10B shows the switch 110 closed, to turn the blade heating system ON, completing current flow through the three blades, and thereby causing the blades to be heated. In FIG. 10C, coil relay 162 is activated to separate the reed contacts 172, 174 of the reed relay switch 170, thereby temporarily interrupting current flow to the blades 124. Thereafter, in FIG. 10D, the relay coil 162 is deactivated to allow the reed contacts 172, 174 to close, thereby closing the reed relay 170 and permitting current flow through the blades 124. The timing of this cycle of opening and closing the reed relay switch can be adjusted, to thereby control the amount of time that current flow is directed through the blades, thereby effectively controlling the temperature level of the blades. Naturally, by controlling the amount of time that current flow is directed to the blades, battery life can be preserved.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A razor comprising:

a handle including a top end;

a blade cartridge adapted for attachment to the top end of said handle and containing at least one electrically conductive blade;

an electric power storage source within said handle;

conductors connecting said at least one blade to said electric power storage source for delivering electric current to said at least one blade, wherein flow of the electric current through said at least one blade causes said blade to be heated;

a switch on said handle selectively operable between an ON status for allowing the electric current flow through said at least one blade and an OFF status for interrupting the electric current flow through said at least one blade;

a control system for selectively controlling the heated temperature of said at least one blade;

a temperature indicator for indicating the heated temperature of said at least blade; and an inductive coupling between said handle and said blade cartridge for electrically connecting said at least one electrically conductive blade to said electric power storage source.

2. The razor as recited in claim 1 wherein said blade cartridge contains a plurality of said electrically conductive blades.

3. The razor as recited in claim 1 further comprising:

a visual indicator for indicating the ON and OFF status of said switch.

4. The razor as recited in claim 3 wherein said visual indicator includes at least one LED.

5. The razor as recited in claim 2 wherein said switch is a slide switch for selectively controlling the electric current flow through one or more of said plurality of electrically conductive blades.

6. The razor as recited in claim 2 wherein said switch is a proximity switch structured to allow the electric current flow through at least one of said plurality of electrically conductive blades upon contact of at least one of the plurality of electrically conductive blades with a user's skin.

7. The razor as recited in claim 2 wherein said switch is a tilt switch structured to allow the electric current flow through at least one of said plurality of electrically conductive blades upon tilting said razor.

8. The razor as recited in claim 1 further comprising:

a rechargeable battery for providing the electric power storage source.

* * * * *